US010885764B2

(12) United States Patent
Seelman

(10) Patent No.: US 10,885,764 B2
(45) **Date of Patent: *Jan. 5, 2021**

(54) METHOD AND APPARATUS FOR DETECTING A HAZARD DETECTOR SIGNAL IN THE PRESENCE OF INTERFERENCE

(71) Applicant: ECOLINK INTELLIGENT TECHNOLOGY, INC., Carlsbad, CA (US)

(72) Inventor: George Seelman, Temecula, CA (US)

(73) Assignee: ECOLINK INTELLIGENT TECHNOLOGY, INC., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/556,714

(22) Filed: Aug. 30, 2019

(65) Prior Publication Data

US 2019/0385433 A1 Dec. 19, 2019

Related U.S. Application Data

(60) Division of application No. 16/152,617, filed on Oct. 5, 2018, now Pat. No. 10,403,119, which is a (Continued)

(51) Int. Cl.
*G08B 21/18* (2006.01)
*G08B 1/08* (2006.01)
(Continued)

(52) U.S. Cl.
CPC ..... *G08B 21/182* (2013.01); *G08B 1/08* (2013.01); *G08B 3/10* (2013.01); *G08B 29/18* (2013.01)

(58) Field of Classification Search
CPC ..... G08B 3/10; G08B 1/08; G08B 21/182; G08B 29/18
See application file for complete search history.

(56) References Cited

U.S. PATENT DOCUMENTS 9,772,671 B1 * 9/2017 Lee ..... G08B 25/008
10,121,352 B2 11/2018 Seelman
(Continued)

OTHER PUBLICATIONS

ISA/US, International Search Report and Written Opinion issued on PCT application No. 17/44954, dated Aug. 29, 2017, 10 pages.

*Primary Examiner* — Hongmin Fan
(74) *Attorney, Agent, or Firm* — Greenberg Traurig, LLP

(57) ABSTRACT

The present disclosure describes methods and apparatus for detecting a pattern warning signal from a hazard detector in the presence of a second pattern warning signal from a second hazard detector. In one embodiment, hazard detector monitoring device converts a pattern warning signal and a second pattern warning signal into a composite electronic signal, each of the first and second pattern warning signals comprising an on-time period followed by an off-time period. Next, the composite electronic signal is converted into a digital signal and then an on-time duration of the digital signal is determined as a time that the digital signal exceeded a first voltage threshold. Finally, an alarm signal is transmitted to a receiver when the pattern warning signal has been determined to be present, based on the on-time duration.

20 Claims, 6 Drawing Sheets

Related U.S. Application Data continuation of application No. 15/814,517, filed on Nov. 16, 2017, now Pat. No. 10,121,352, which is a continuation of application No. 15/226,809, filed on Aug. 2, 2016, now Pat. No. 9,836,947.

(51) Int. Cl.
*G08B 29/18* (2006.01)
*G08B 3/10* (2006.01)

(56) References Cited

U.S. PATENT DOCUMENTS

| | | | | |
|---|---|---|---|---|
| 2004/0145467 | A1 | 7/2004 | Roby et al. | |
| 2011/0025499 | A1* | 2/2011 | Hoy ..... | G08B 13/1672 340/540 |
| 2014/0218194 | A1 | 8/2014 | Gruber et al. | |

* cited by examiner

METHOD AND APPARATUS FOR DETECTING A HAZARD DETECTOR SIGNAL IN THE PRESENCE OF INTERFERENCE

CROSS-REFERENCE TO RELATED APPLICATION

The present application is a divisional of U.S. patent application Ser. No. 16/152,617 filed on Oct. 5, 2018, which is a continuation of U.S. patent application Ser. No. 15/814,517 filed on Nov. 16, 2017, now U.S. Pat. No. 10,121,352, which is a continuation of U.S. patent application Ser. No. 15/226,809, filed on Aug. 2, 2016, now U.S. Pat. No. 9,836,947.

BACKGROUND

I. Field of the Invention

The present invention relates to home hazard detection and, more particularly, to a method and apparatus for detecting an audible hazard detector in the presence of interference.

II. Description of Related Art

Many homes and businesses contain hazard detectors such as smoke detectors and carbon monoxide detectors. Such detectors are typically purchased by consumers at the retail level and installed in their homes or businesses. When a fire or carbon monoxide is detected, these detectors typically emit a piercing siren and/or visual effect (e.g., flashing light). However, older people often have hearing or mobility difficulty and remain at a significantly increased risk of injury even if the audible alarm sounds.

Home security monitoring vendors such as Ackerman or ADT™ offer networked detectors as part of security system package. In these systems, when a smoke or carbon monoxide detector is triggered, a wireless, RF signal is transmitted from the detector to a security panel located in the home, and then the security panel alerts fire, police, or other first responders via wired or wireless communications. However, these network detectors are typically system-specific and expensive, and are not generally used for middle and low income housing.

Recently, new audible detectors have been introduced into the marketplace to allow traditional, audible hazard detectors to communicate with home security systems. Such new audible detectors identify the audible siren emitted by such detectors when a hazard condition is detected, and transmit an RF signal to the security panel, where authorities may be notified by the security panel.

One problem with such new audible detectors, however, is that they typically are not able to identify an audible hazard detector from one hazard detector when two or more hazard detectors are sounding. This is because the audible signals emitted from these hazard detectors overlap as a function of time and, further, can cause modulation of the amplitude of these signals as the signals move in and out of phase from each other. As a result, such new audible detectors may not recognize when a hazard condition is occurring, and therefore no indication is provided to the security panel to call for help.

Thus, it would be desirable to be able to detect when a hazard detector is sounding in the presence of one or more additional hazard detector sirens.

SUMMARY

Embodiments of the present invention comprise methods and apparatus for detecting a pattern warning signal from a hazard detector in the presence of a second pattern warning signal from a second hazard detector.

In one embodiment, an apparatus for detecting a pattern warning signal from a hazard detector in the presence of a second pattern warning signal from a second hazard detector is described, comprising a transducer for converting the pattern warning signal and the second pattern warning signal to a composite electronic signal, each of the first and second pattern warning signals comprising an on-time period followed by an off-time period, an analog-to-digital converter for converting the composite electronic signal into a digital signal, a memory for storing processor-executable instructions and one or more thresholds, a transmitter for transmitting an alarm signal. a processer coupled to the transducer, the memory and the transmitter for executing the processor-executable instructions that causes the apparatus to determine an on-time duration of the digital signal as a time that the digital signal exceeded a first voltage threshold, and transmit an alarm signal to a receiver when the pattern warning signal has been determined to be present, based on the on-time duration.

In another embodiment, a method for detecting a pattern warning signal from a hazard detector in the presence of a second pattern warning signal from a second hazard detector is described, comprising converting the pattern warning signal and the second pattern warning signal into a composite electronic signal, each of the first and second pattern warning signals comprising an on-time period followed by an off-time period, converting the composite electronic signal into a digital signal, determining an on-time duration of the digital signal as a time that the digital signal exceeded a first voltage threshold, and transmitting an alarm signal to a receiver when the pattern warning signal has been determined to be present, based on the on-time duration.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION

The present disclosure describes a method and apparatus for detecting, by a hazard detector monitoring device, an audible pattern warning signal emitted from a hazard detector in the presence of interference. The interference may comprise a second, audible pattern warning signal emitted from a second hazard detector within audible range of the hazard detector monitoring device. Receiving both audible signals at the same time may render the hazard detector monitoring device unable to identify the presence of one or the other pattern warning signals.

Figure 1:
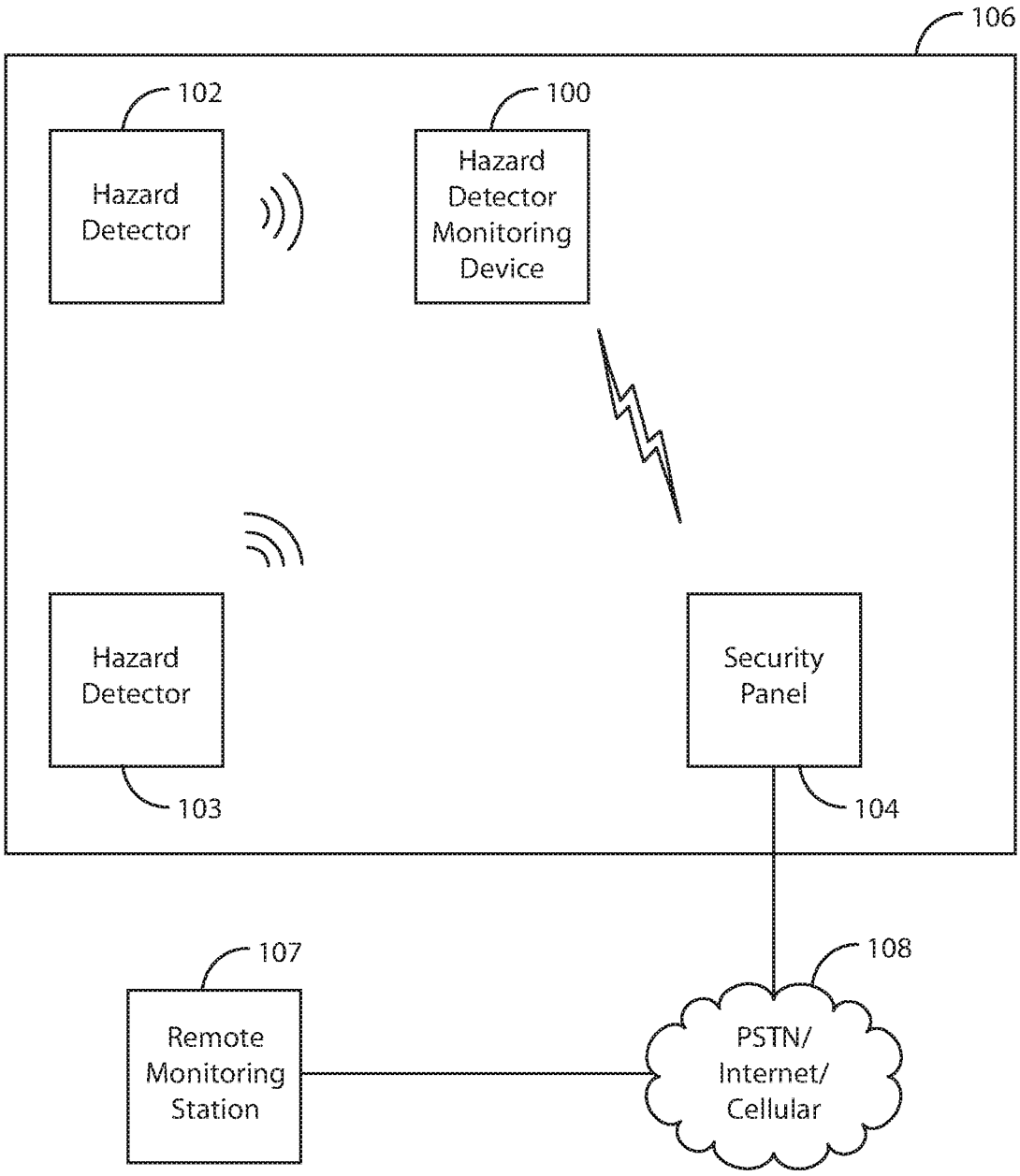
FIG. 1 illustrates one embodiment of a hazard detector monitoring device for detecting the presence of an audible pattern warning signal emitted by one or more hazard detectors.
Figure 4:
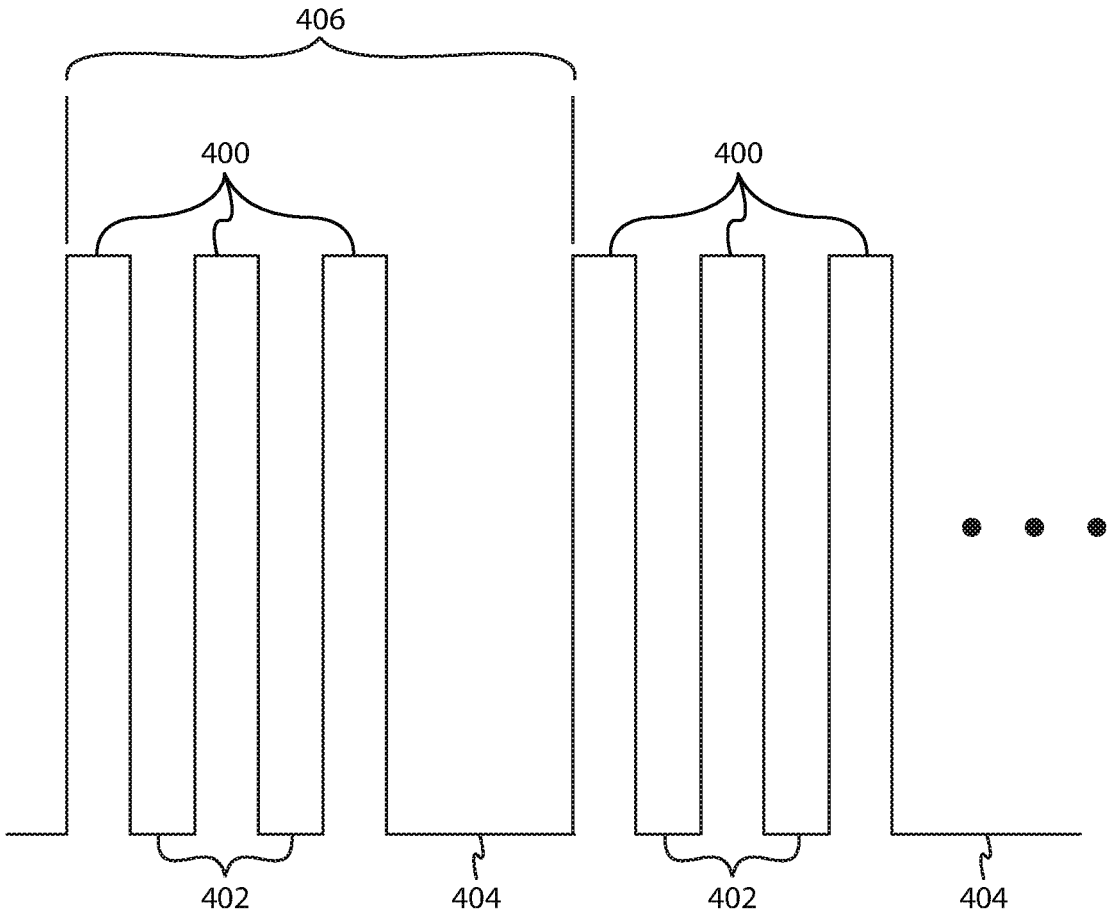
FIG. 4 illustrates a typical T-3 temporal pattern.
Figure 5:
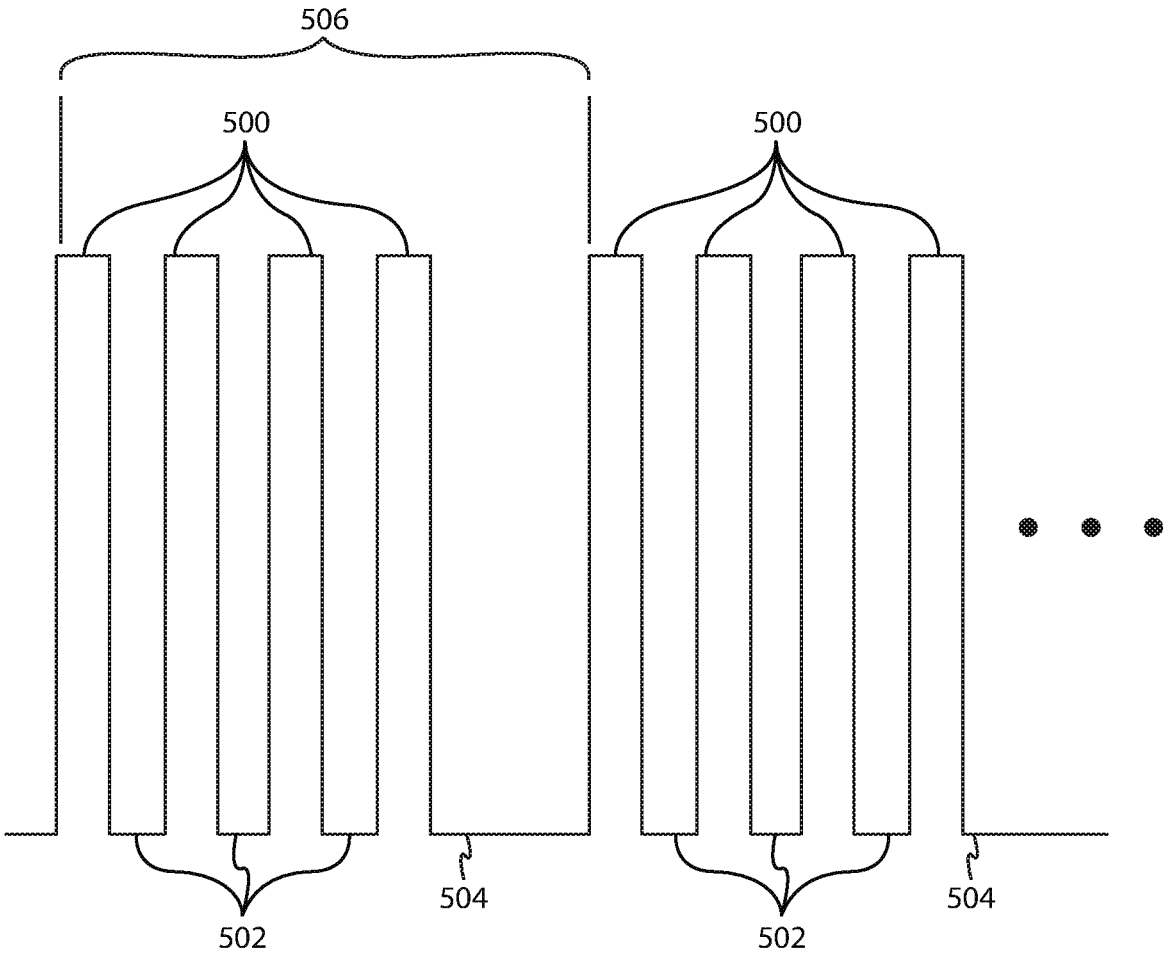
FIG. 5 illustrates a typical T-5 temporal pattern.

FIG. 1 illustrates one embodiment of a hazard detector monitoring device 100 for detecting the presence of an audible pattern warning signal emitted by a hazard detector such as hazard detector 102 or hazard detector 103 in the form of, for example, a smoke or carbon monoxide detector. The detectors are typically located at several locations throughout premises 106 along with hazard detector monitoring device 100 located at a position proximate to one of the detectors. Although only two hazard detectors are shown in FIG. 1, in general, three are more hazard detectors are typically used, with the number of detectors being dictated by the size of premises 106. When hazard detector monitoring device 100 detects a pattern warning signal emitted from one or more hazard detectors, it transmits an alarm signal to a receiver, such as home security panel 104, for communication to a remote monitoring center 107 via a network 108, such as a PSTN, Wide Area network, such as the Internet, and/or cellular voice and/or data network. The term "pattern warning signal" as used herein refers to an audible or visual signal that comports to a temporal pattern, such as an ISO 8201 and/or ANSFASA 53.41 temporal pattern, presenting the audible or visual signal in a series of timed "pulses" of sound or light. Most smoke detectors manufactured today comport to the ISO/ANSFASA standard, which requires an interrupted four count (three half second audio or visual pulses, followed by a one and one half second pause, commonly repeated for a minimum of 180 seconds). This is commonly known as a "Temporal Three" or T-3 pattern. Similarly, modern carbon monoxide detectors comport to a "Temporal Four" or T-4 format, comprising an interrupted five count (four half second audio or visual pulses, followed by a one and one half second pause). Thus, a type of hazard can be determined by knowing whether an alarm signal comprises a T-3 or a T-4 temporal pattern. FIG. 4 illustrates a typical T-3 temporal pattern, while FIG. 5 illustrates a typical T-4 temporal pattern, each illustration showing a repeating, time-varying signal comprising "on-time" periods, or "pulses" or "peaks" 400/500. These on-time periods represent an "envelope" of a high-frequency signal corresponding to a high-frequency audible tone produced by the hazard detectors when they detect a hazard condition, such as the presence of smoke and/or carbon monoxide. The temporal characteristic comprises a number of on-time periods 400/500 and off-time periods 402/502, followed by a "long lull period", shown in FIGS. 4 and 5 as long lull period 404 and 504, respectively. The off-time periods 402/502 may be equal in duration to the on-time periods 400/500, respectively. In another embodiment, the off-time periods 402/502 may comprise a duration that is different than the on-time periods 400/500, respectively.

Hazard detectors 102 and 103 may comprise any one or more of a smoke detector, fire detector, carbon monoxide detector, natural gas detector, radon detector, or any other device that detects one or more hazardous conditions. For example, each of the hazard detectors may comprise a model KID442007 smoke detector manufactured by Kidde, Inc. of Mebane, N.C. and/or a carbon monoxide detector such as model C0400, manufactured by First Alert, Inc. of Aurora, Ill., or a model KN-COSM-B combination smoke detector and carbon monoxide detector also manufactured by Kidde. The hazard detectors are typically battery-operated and generally have no native capability to send or receive wireless communication signals of any kind.

Receiver 104, in this embodiment shown as a security panel, is part of an overall security system for homes or businesses, for example, a Safewatch QuickConnect™ system sold by ADT™ of Boca Raton, Fla. Typically, these home security systems use wireless sensors in communication with a security panel to monitor doors and windows for detection of any unauthorized entries into premises 106. If an unauthorized entry is detected by a sensor, a signal is transmitted to the security panel, which in turn may alert remote monitoring center 107 so that the proper authorities may respond to the unauthorized entry. Similarly, when the security panel receives a signal from one of the hazard detectors configured to communicate with the security panel using RF communication signals, the security panel may also contact remote monitoring center 107 to provide an alert that a hazard, such as smoke or carbon monoxide, has been detected. Generally, however, hazard detectors are not configured with electronics to transmit RF signals to the security panel.

Hazard detector monitoring device 100 typically comprises transducer 204, comprising one or more microphones or other suitable transducers, to convert ambient sound in proximity to hazard detector monitoring device 100 into electronic signals. Preferably, transducer 204 comprises one or more conventional piezo microphones, typically small in size and well known in the art. In one embodiment, an array of two or more microphones are used in order to provide differential sound detection. This enhances the ability for hazard detector monitoring device 100 to detect audio signals from hazard detector 102 or 103 in an environment where their pattern warning signals may bounce off of walls, furniture, etc., potentially creating difficult conditions under which hazard detector monitoring device 100 may properly detect pattern warning signals from the hazard detectors. Using two or more microphones enables spatial-diversity to occur, thus increasing the ability of hazard detector monitoring device 100 to detect one or more pattern warning signals that may be tainted with such reflected signals.

Transducer 204 may, alternatively or in addition, comprise a visual detection device including one or more photosensitive LEDs or other suitable device(s) capable of sensing illumination produced by one or more of the hazard detectors when a hazard condition is sensed. Such illumination may be modulated by the hazard detectors to produce a visual pattern warning signal in conformance with a T-3 or T-4 cadence.

The pattern warning signal emitted by the hazard detectors typically comprises an audible signal usually around 3200 Hz at 45 dB to 120 dB, weighted for human hearing. The pattern warning signal typically complies with the well-known Temporal-Three alarm signal, often referred to as T3 (ISO 8201 and ANSI/ASA 53.41 Temporal Pattern) which is an interrupted four count (three half second pulses, followed by a one and one half second pause, repeated for a minimum of 180 seconds). CO2 (carbon monoxide) detectors are specified to use a similar pattern using four pulses of tone (often referred to as temporal-4 or T4).

Hazard detector monitoring device 100 detects the presence of sound and/or light emanating from one or more hazard detectors 102 by evaluating the decibel level, frequency, cadence, and/or other characteristics of the signals.

For example, in the embodiment shown in FIG. 1, transducer 204 may receive an audible signal produced by hazard detector 102, and then determine whether the audible signal comports to, for example, an audio signal at 3.2 kHz having a T-3 or T-4 temporal characteristic or cadence. If so, hazard detector monitoring device 100 transmits a signal to receiver 104, using wired or wireless communication methods, indicating that a hazard condition has been detected. Preferably, hazard detector monitoring device 100 is configured to distinguish the type of alarm condition based on the type of signal detected from hazard detector 102. For example, if a T-3 cadence is detected, hazard detector monitoring device 100 may transmit a signal to receiver 104 indicating that a smoke or fire hazard has been detected. If a T-4 cadence is detected, hazard detector monitoring device 100 may transmit a signal to receiver 104 indicating that a carbon monoxide hazard has been detected.

Receiver 104 is programmed to contact a remote monitoring center 107 upon receipt of a signal from hazard detector monitoring device 100 or from any of the door or window sensors, to inform the remote monitoring center that an alarm condition has been detected and, in one embodiment, an indication of the type of alarm, such as smoke, carbon monoxide, etc.

Figure 2:
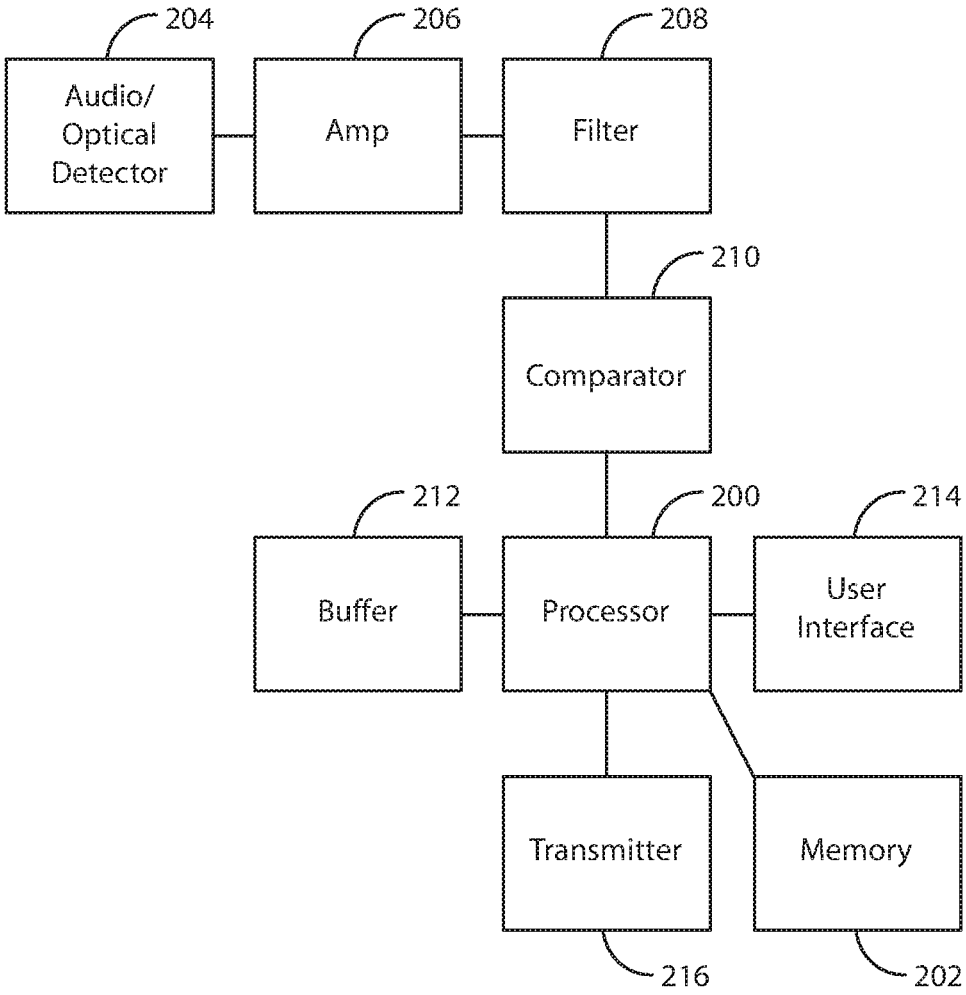
FIG. 2 is a functional block diagram of one embodiment of the hazard detector monitoring device shown in FIG. 1.

FIG. 2 is a functional block diagram of one embodiment of hazard detector monitoring device 100. In this embodiment, hazard detector monitoring device 100 comprises a processor 200, a memory 202, a transducer 204, an amplifier 206, a filter 208, a comparator 210, a buffer 212, a user interface 214, and a transmitter 216. It should be understood that not all of the functional blocks shown in FIG. 2 are required for operation of hazard detector monitoring device 100 in all embodiments (for example, amplifier 206 or buffer 212), that the functional blocks may be connected to one another in a variety of ways, and that additional function blocks may be used (for example, additional amplification or filtering).

Processor 200 is configured to provide general operation of hazard detector monitoring device 100 by executing processor-executable instructions stored in memory 202, for example, executable code. Processor 200 typically comprises a general purpose processor, such as an ADuC7024 analog microcontroller manufactured by Analog Devices, Inc. of Norwood Mass., although any one of a variety of microprocessors, microcomputers, microcontrollers, and/or custom ASICs suitable for use in a small, battery-operated electronic device may be used alternatively.

Memory 202 comprises one or more information storage devices, such as RAM, ROM, EEPROM, UVPROM, flash memory, SD memory, XD memory, or virtually any other type of electronic, optical, or mechanical memory device suitable for a small, battery-operated electronic device. Memory 202 is used to store the processor-executable instructions for operation of hazard detector monitoring device 100 as well as any information used by processor 200 to detect whether an audio and/or optical pattern warning signal has been generated by hazard detector 102, 103, or both. For example, memory 204 may store a number of voltage or time thresholds for comparison to electronic signals provided by comparator 210. Memory device 202 could, alternatively or in addition, be part of processor 200, as in the case of a microcontroller comprising on-board memory.

Transducer 204 comprises one or more microphones or other suitable audio transducers to convert ambient audio signals into electronic signals suitable for processing. Preferably, transducer 204 comprises one or more conventional piezo microphones, typically small in size and well known in the art. In one embodiment, an array of two or more microphones is used in order to provide differential sound detection. This enhances the ability for hazard detector monitoring device 100 to detect audio signals from hazard detector 102 in an environment where the audio signals bounce off of walls, furniture, etc.

Transducer 204 may also comprises an optical detector comprising one or more photo-sensitive LEDs or other suitable device(s) capable of sensing an illumination signal produced by one or more of the hazard detectors in response to a hazard detector sensing a hazardous condition.

Amplifier 206 comprises circuitry used to amplify the magnitude of the electronic signal from transducer 204 to a level suitable for filter 208 to process. Amplifier 206 may comprise one or more of any number of well-known amplifiers, such as in the form of discreet components (e.g., one or more transistors, op-amps, resistors, capacitors, etc.), an integrated circuit, or part of a custom ASIC. In one embodiment, amplifier 206 amplifies the signal from transducer 204 by a factor of 40, resulting in a signal to filter 208 of between zero and the voltage limit of the amplifier, typically three volts.

Filter 208, in one embodiment, comprises a bandpass filter centered at a frequency equal to a modulation frequency of the pattern warning signal. For example, filter 208 may comprise a Chebyshev filter, centered at 3.1 kHz, as many smoke or carbon monoxide detectors in use emit an audio pattern warning signal at 3.1 kHz, with some variation expected. In other embodiments, filter 208 could alternatively comprise a highpass filter and/or a lowpass filter. The bandpass of filter 208 is wide enough to allow for such variation between different smoke/carbon monoxide detectors, such as a bandpass of 2 kHz, but narrow enough to attenuate any extraneous audible signals, such as sound from TVs, people, animals, and generally sounds other than the audio pattern warning signal from a hazard detector. Filter 208 may comprise discreet components such as one or more transistors, op-amps, resistors, capacitors, etc., an integrated circuit, or part of a custom ASIC.

The output from filter 208 is provided to comparator 210. Comparator 210 is used to present digital "1"s and "0"s to processor 200 for use in determining whether a pattern warning signal is present. Typically, a fixed DC voltage is also presented to comparator 210 for comparison to the signal from filter 208. The fixed DC voltage is selected at some point greater than the mid-point between the voltage supplied to comparator 210 and ground, or between two supply voltages. The voltage may be selected by such factors as the decibel level of hazard detector 102, the location of hazard detector 102 in proximity to alarm detector hazard detector monitoring device 100, the gain of amplifier 206, the type of transducer 204, other factors, or a combination thereof, in order to present a signal within the input voltage range of processor 200. When a voltage greater than the threshold voltage is presented to comparator 210, a digital "1" is produced, and when the voltage to comparator 210 is less than the threshold voltage, a digital "0" is produced. The threshold voltage is chosen high enough so that a small magnitude sound wave presented to transducer 204 result in a "0", such as sounds from a TV or conversation, or even by loud sounds (e.g., dog barking, boiling tea kettles) located some distance away from hazard detector 102. Additionally, the threshold voltage is chosen low enough to ensure that large magnitude sound waves presented to audio/visual transducer 204, such as those from hazard detector 102 in close proximity to alarm detector hazard detector monitoring device 100, results in a "1" being produced. In this way, comparator 102 acts like a one-bit, variable-threshold analog-to-digital converter, converting an electronic, analog signal from filter 210 to a digital signal determined by the voltage level of the analog signal compared to the threshold voltage. In other embodiments, a multi-bit analog-to-digital comparator may be used.

Buffer 212 comprises one or more information storage devices, such as a RAM memory, or other type of volatile electronic, optical, or mechanical memory device. Buffer 212 could, alternatively or in addition, be part of processor 200, as in the case of a microcontroller comprising on-board memory, or a custom ASIC. Buffer 212 is used to store the digital information generated by comparator 210. Buffer 212 includes a predetermined number N memory locations each configured to store a digital value from comparator 210, and as all N locations become populated with digital information, new samples begin replacing the oldest samples in a first-in-first-out (FIFO) manner. In one embodiment, the use of DMA by processor 200 allows storage independent of the processes being executed by processor 200, effectively freeing processor 200 to perform other functions as digital information from comparator 210 is generated. The number of memory locations comprising buffer 212 will vary in one embodiment vs. another, as will be described later herein. Typically, digital information generated by comparator 210 is stored in buffer 212 at predetermined time intervals, for example every 20 milliseconds.

User Interface 214 may be provided which generally comprises hardware and/or software necessary for allowing a user of hazard detector monitoring device 100, such as a homeowner, to perform various tasks such as to check the status of a battery, send a test signal to receiver 104, put hazard detector monitoring device 100 into a particular mode of operation such as "armed mode" where hazard detector monitoring device 100 transmits a signal to receiver 104 upon detection of an audible/visual alarm produced by hazard detector 102, among others. Such hardware and/or software may comprise switches, pushbuttons, touchscreens, and other well-known devices.

Transmitter 216 comprises circuitry necessary to wirelessly transmit signals from hazard detector monitoring device 100 to one or more remote destinations, such as receiver 104 and/or some other remote entity, such as to a cellular network for delivery to a personal communication device, such as a wireless smartphone. Such circuitry is well known in the art and may comprise BlueTooth, Wi-Fi, Sigsbee, X-10, Z-wave, RF, optical, or ultrasonic circuitry, among others. Alternatively, or in addition, transmitter 216 comprises well-known circuitry to provide signals to a remote destination via wiring, such as telephone wiring, twisted pair, two-conductor pair, CAT wiring, or other type of wiring.

Figure 3:
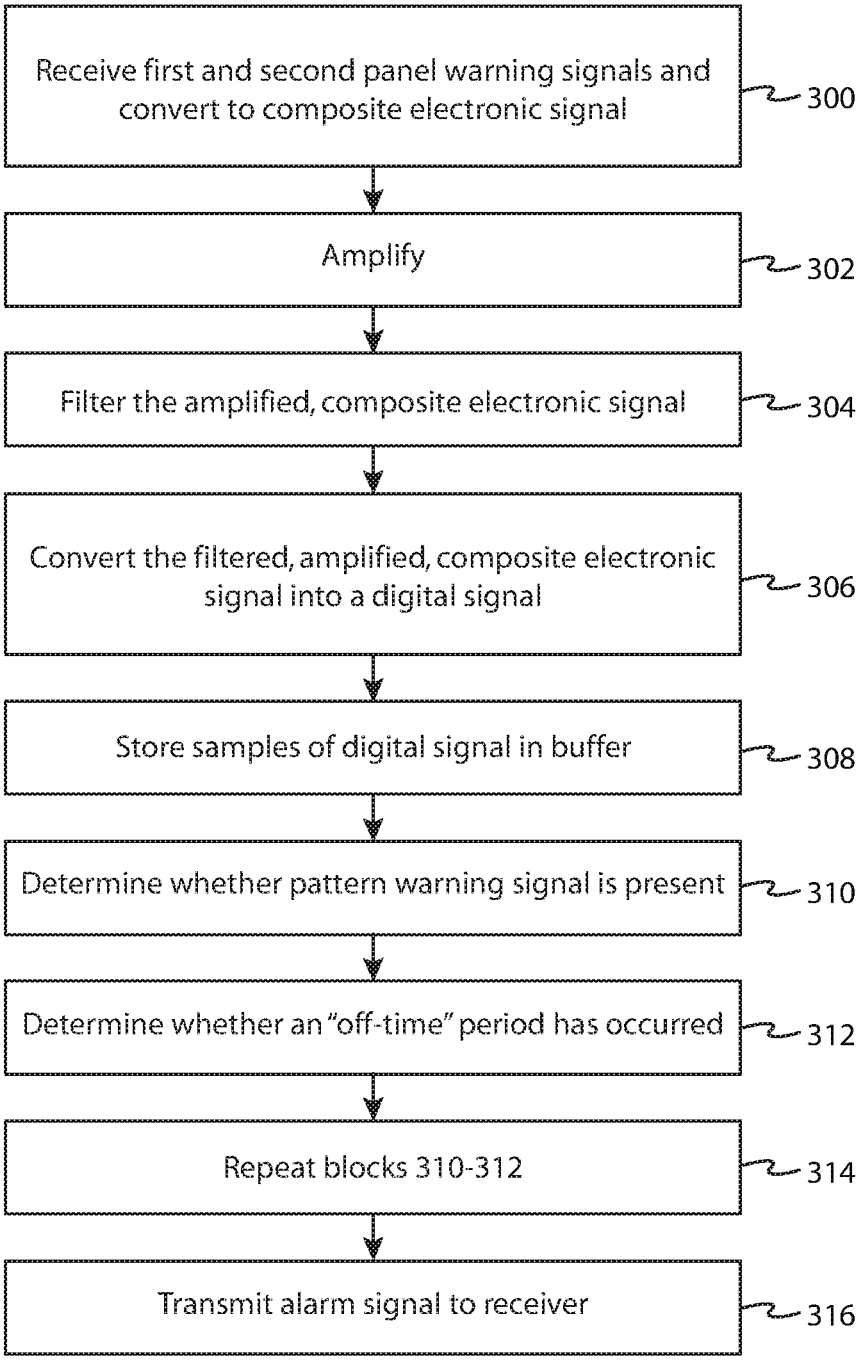
FIG. 3 is a flow diagram illustrating one embodiment of detecting an audible pattern warning signal from a hazard detector in the presence of interference, such as the presence of a second, audible pattern warning signal from a second hazard detector.

FIG. 3 is a flow diagram illustrating one embodiment of detecting an audible pattern warning signal from a hazard detector in the presence of interference, such as the presence of a second, audible pattern warning signal from a second hazard detector. The method is implemented by processor 200 executing processor-readable instructions stored in the memory 202 shown in FIG. 1. It should be understood that in some embodiments, not all of the steps shown in FIG. 3 are performed and that the order in which the steps are carried out may be different in other embodiments. It should be further understood that some minor method steps have been omitted for purposes of clarity. Finally, it should be understood that although much of the discussion related to FIG. 3 references audible signals sensed by an audio detector only, it is intended that such discussion additionally relate to light signals and the use of optical detectors either additionally, or in the alternative.

The method described by FIG. 3 allows hazard detector monitoring device 100 to detect the presence of an audible pattern warning signal even when second pattern warning signal 602 is received. Second pattern warning signal 602 is shown in dashed lines in order for the two signals to be more easily distinguished from each other, for explanatory purposes. The second pattern warning signal 602 may be considered to be an interference signal because it normally would interfere with prior art hazard detector monitoring device 100's from detecting that either pattern warning signal is present.

Figure 6:
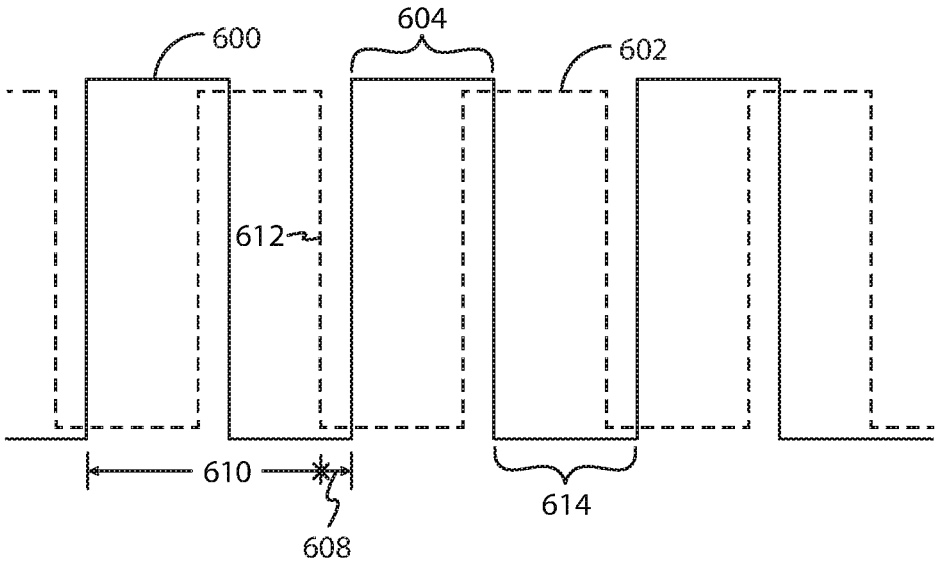
FIG. 6 illustrates two overlapping temporal patterns that are offset from one another.

FIG. 6 is a graph of amplitude vs. time of first and second pattern warning signals 600 and second panel warning signal 602, respectively, showing their respective timing and amplitude characteristics. The first and second pattern warning signals are offset from one another by almost 500 milliseconds. Generally, due to a number of factors, it is practically impossible for the two signals to align precisely with one another, so it is expected that a time offset will almost always be present between the two signals. In the embodiment shown in FIG. 6, each pattern warning signal comprise three pulses or "on-time" periods 604, each having a duration of approximately 500 milliseconds, spaced apart from each other by "off-time" periods 614 of approximately 650 milliseconds and a long lull time period (not shown) equal to approximately one and a half (1½) seconds. The method described by FIG. 3 is in reference to the two pattern waning signals.

Figure 7:
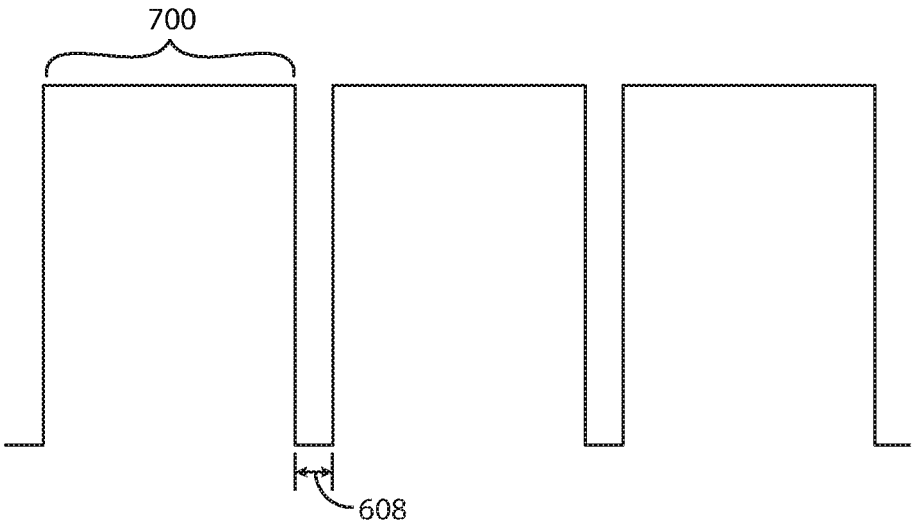
FIG. 7 is a graph of amplitude vs. time of the output of an analog-to-digital converter when both the pattern warning signals of FIG. 6 are present.

FIG. 7 is a graph of amplitude vs. time of the output of comparator 210 when both pattern warning signals are present, referred to herein as composite signal 700. Composite signal 700 is formed from the combination of the two pattern warning signals shown in FIG. 6 as they add together.

At block 300, transducer 204 receives first panel warning signal 600 and second panel warning signal 602 simultaneously after hazard detector 102 and 103 have each detected a hazardous condition within premises 106, such as the presence of smoke or carbon monoxide. These acoustic signals are converted into a composite electronic signal, representing a summation of the two pattern warning signals, and provided to amplifier 206. In another embodiment, transducer 204 comprises circuitry for detecting light signals produced the hazard detectors, such as one or more photodiodes, phototransistors, or other light-sensitive devices. In one embodiment, the photodiodes, phototransistors, or other light-sensitive devices are chosen to detect light signals in a frequency range produced by a typical hazard detector. In any case, transducer 204 converts the optical signals into a composite electronic signal for use by amplifier 206. In an embodiment where transducer 204 comprises both an audio detector and an optical detector, two streams of electronic signals are produced and processed separately, in one embodiment, by adding another amplifier, filter, and comparator similar to amplifier 206, filter 208, and comparator 210 and providing the output of the second comparator to processor 200.

At block 302, the composite electronic signal from transducer 204 is provided to amplifier 206, where amplifier 206 amplifies the electronic signal. In one embodiment, the electronic signal is amplified by a factor of 40. In other embodiments, an automatic gain control feature may be incorporated into the circuitry of amplifier 206, to maintain an output signal that is within a usable voltage range of filter 208. In some cases, amplifier 206 may actually attenuate the electronic signal from transducer 204 if, for example, a hazard detector is located very close to hazard detector monitoring device 100 and/or the audible signal from the hazard detector is very loud. In any case, the amplified analog signal is the provided to filter 208.

At block 304, filter 208 attenuates frequencies in the amplified composite electronic signal outside the passband of filter 208 to produce a filtered, amplified, composite electronic signal. The passband center frequency and bandpass are selected to attenuate sounds other than those produced by the hazard detectors.

At block 306, the filtered, amplified, composite electronic signal is provided to comparator 210, where it is compared with a threshold voltage that is also provided to comparator 210, as discussed previously. Comparator 210 converts the filtered, amplified, composite electronic signal into a digital signal comprising digital "1"s and "0"s and provides the digital signal to processor 200. Alternatively, the digital signal may be stored into buffer 212, where processor 200 can analyze the values stored in buffer 212 at a later time.

At block 308, in one embodiment, processor 200 receives the digital signal from comparator 210 and stores the digital samples from the digital signal into buffer 212 in a first-in, first-out (FIFO) manner, as discussed previously. In one embodiment, the digital samples are stored using DMA that allows storage of the digital samples independent of other processes executed by processor 200, effectively freeing the processor 200 to determine if a pattern warning signal has been received based on the digital samples stored in buffer 212. In one embodiment, buffer 212 comprises 64 memory locations, and processor 200 stores each new digital sample in a first memory location, while shifting any previously-stored digital samples to a next respective, adjacent memory location. When buffer 212 is full, processor 200 continues storing new data samples in the first memory location and shifting each of the previously-stored digital samples to the next, sequential memory location, causing the last digital sample in buffer 212 to be ejected from buffer 212. Thus, buffer 212 acts as an evaluation window of time equal to the number of memory locations multiplied by the rate at which digital samples are added to buffer 212. For example, if buffer 212 comprises hazard detector monitoring device 100 memory locations and processor 200 stores digital samples at a rate of one sample every 20 milliseconds, buffer 212 essential captures a 2 second window of time (hazard detector monitoring device 100 memory locations times 20 milliseconds) of audio information received by transducer 204.

At block 310, in one embodiment, processor 200 determines if a pattern warning signal has been received based on some or all of the digital samples stored in buffer 212, in one embodiment, or directly from comparator 210 in another embodiment. The remainder of the discussion will assume either case. In one embodiment, processor 200 evaluates the samples from comparator 210 at predetermined time intervals, such as once every 20 milliseconds, every 30 milliseconds, or some other time period typically at least an order of magnitude less than the period of a typical pattern warning signal.

In one embodiment, processor 200 compares the digital signal from comparator 210 to a first voltage threshold to determine when the digital signal from comparator 210 transitions from a "low" state to a "high" state. Those skilled in the art will understand that there are numerous other ways to determine how to detect an electronic signal that transitions from a low state to a high state. The first voltage threshold may be set anywhere between the high state and the low state (i.e., a voltage representative of a high state and a voltage representative of a low state), however it is typically chosen approximately mid-way between the high and low states.

When the transition is detected, processor 200 begins tracking how long the digital signal from comparator 210 remains at in the high state, either by starting a clock when the transition is detected, counting a number of samples that have been processed, or one of other techniques well known in the art.

When the digital signal from comparator 210 is determined by processor 200 to have transitioned from the high state to the low state, the time that the digital signal remained high is compared to "duration thresholds" stored in memory 204. Determination that the digital signal transitioned from the high state to the low state may be accomplished by processor 200 comparing the digital signal from comparator 210 to a second voltage threshold to determine when the digital signal from comparator 210 falls below the threshold, indicating a transition from the high state to the low state. In one embodiment, the second voltage threshold is equal to the first voltage threshold.

The duration thresholds comprise an on-time "minimum duration threshold" and an on-time "maximum duration threshold", and both are stored in memory 202. The duration on-time thresholds are representative of a typical on-time period 604 of a pattern warning signal, with some margin of error to account for small deviations in pattern warning signals emitted by various hazard detectors. In a typical on-time period 604 lasting 500 milliseconds, the range of values may be set to +/−10%, for example, resulting on a lower time threshold of 450 milliseconds and an upper time threshold of 550 milliseconds.

However, in order to detect first pattern warning signal 600 when second pattern warning signal 602 is present, the maximum on-time duration threshold is increased to a time period 610 that is slightly less than twice the typical on-time period 604, shown in FIG. 6 as "gap time" period 608. For example, if the typical on-time period 604 is 500 milliseconds, then the maximum on-time duration threshold is set to 1,000 milliseconds, less gap time period 608 in order to allow processor 200 to detect a high-to-low transition. Gap time period 608 may be set to a value equal to the periodic sampling rate of processor 200, or a multiple thereof, such as 20 milliseconds, or some other value. In general, gap time period 608 is typically less than ten percent of on-time period 604.

Without the use of gap time period 608, processor 200 would not be able to detect either the first or second pattern warning signals if second pattern warning signal 602 was offset from first pattern warning signal 600 by exactly 500 milliseconds.

FIG. 7 is a graph of amplitude vs. time of the digital signal from comparator 210, showing the two pattern warning signals of FIG. 6 summed with each other. The offset between first pattern warning signal 600 and second pattern warning signal 602 in FIG. 7 shows one example of a maximum offset that second pattern warning signal 602 may be from first pattern warning signal 600 and still enable processor 200 to detect first pattern warning signal 600. The offset between the two pattern warning signals may vary with time due to, for example, inherent component tolerance differences between hazard detector 102 and hazard detector 103. Thus, the calculated on-time period 700 of the digital signal from comparator 210 may vary from on-time period 604 to just less than twice the on-time period 604, i.e., twice the on-time period 604 less gap time period 608. In general, gap time period 608 is set to a small number to allow for detection of first pattern warning signal 600 in the presence of second pattern warning signal 602 for any offset except for an offset that occurs when second pattern warning signal 602 is offset having a falling edge 612 occurring during gap time period 608. Thus, it is generally advantageous set gap period 608 as small as possible.

When processor 200 determines that a valid on-time period has occurred (i.e., that the digital signal from comparator 210 has remained high for more than the minimum on-time duration threshold and less than the maximum on-time duration threshold), processor 200 next determines if a valid off-time period has occurred.

At block 312, processor 200 evaluates the digital signal from comparator 210 to determine whether an off-time period 614 has occurred. Processor 200 determines when the digital signal from comparator 210 has changed state from high to low, then tracks the time that composite signal 700 remains low. Since second pattern warning signal 602 may be offset from first pattern warning signal 600 by a large amount (for example, 480 milliseconds), the amount of time that the digital signal remains low could be as short as only 20 milliseconds. Processor 200 determines when composite signal 700 changes state from low to high, then calculates the time that the digital signal from comparator 210 remained low. Processor 200 then compares this calculated "low time" to thresholds stored in memory 204 to determine whether the calculated low time falls within the thresholds. In the example shown in FIG. 6, the off-time period 614 of a typical pattern warning signal is 650 milliseconds. Thus, in one embodiment, an off-time minimum duration threshold is set to a value between zero and the gap time period 608, and an upper threshold is set to 650, plus 10% to account for variances in pattern warning signals received from different hazard detectors, in one embodiment. In one embodiment, only the off-time maximum duration threshold is used to determine whether an off-time period occurred.

At block 314, the methods described in blocks 310 and 312 are repeated and when an on-time period is followed by an off-time period three times, in this embodiment, processor 200 determines that a pattern warning signal is present from at least one of the hazard detectors. In other embodiments, a determination that a pattern warning signal is present may occur when only a first on-time period is detected, when a first off-time period is detected, when an on-time period is detected followed by an off-time period, or various combinations of on-time periods and off-time periods.

At block 316, after processor 200 has determined that at least one pattern warning signal is present, processor 200 causes transmitter 216 to send an alarm signal to receiver 104, such as a security panel, in one embodiment. In other embodiments, the receiver may comprise a security or home automation hub or gateway located inside premises 106 or a wireless router for sending the alarm signal directly to a location remote from premises 106 for processing. In another embodiment, Therefore, having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

What is claimed is:

1. An apparatus for detecting when a hazardous condition is present inside a structure, comprising:

a transducer for converting a first pattern warning signal received from a first hazard detector and a second pattern warning signal received from a second hazard detector into a composite electronic signal;

an analog-to-digital converter for converting the composite electronic signal into a digital signal;

a memory for storing processor-executable instructions and one or more thresholds;

a transmitter for transmitting an alarm signal; and a processor coupled to the analog-to-digital converter, the memory and the transmitter for executing the processor-executable instructions that causes the apparatus to:

determine, by the processor, that the hazardous condition is present based on the digital signal; and transmit, by the processor via the transmitter, the alarm signal to a receiver when the hazardous condition has been determined to be present.

2. The apparatus of claim 1, wherein the processor-executable instructions that cause the apparatus to determine that the hazardous condition is present comprise instructions that causes the apparatus to:

determine an on-time duration of the digital signal as a time that the digital signal exceeded a first voltage threshold stored in the memory; and determine that the hazardous condition is present when the on-time duration is great than a minimum duration threshold stored in the memory, and less than a maximum duration threshold stored in the memory.

3. The apparatus of claim 2, wherein the maximum duration threshold comprises a time that is twice the on-time of a temporal-3 signal, less a gap time.

4. The apparatus of claim 3, wherein the gap time comprises a time period less than 10 percent of on on-time of the temporal-3 signal.

5. The apparatus of claim 2, wherein the maximum duration threshold comprises a time that is twice the on-time of a temporal-4 signal, less a gap time.

6. The apparatus of claim 5, wherein the gap time comprises a time period less than 10 percent of the on-time of the temporal-4 signal.

7. The apparatus of claim 2, wherein the processor-executable instructions comprise further instructions that cause the apparatus to:

after determining the on-time of the digital signal, determine an off-time duration of the digital signal; and determine that the hazardous condition is present when the on-time duration of the digital signal is greater than the minimum duration threshold and less than the maximum duration threshold, and the off-time duration of the digital signal is less than or equal to a maximum off-time duration threshold stored in the memory.

8. The apparatus of claim 7, wherein the processor-executable instructions that cause the apparatus to determine the off-time duration of the digital signal comprise instructions that cause the apparatus to:

determine an off-time duration that the digital signal remains below the first voltage threshold;

compare the off-time duration with a maximum off-time duration stored in the memory; and determine that the hazardous condition is present when the processor determines that the off-time duration of the digital signal is less than or equal to the maximum off-time duration.

9. The apparatus of claim 7, wherein the processor-executable instructions that cause the apparatus to determine the off-time duration of the digital signal comprise instructions that cause the apparatus to:

determine an off-time duration that the digital signal remains below the first voltage threshold;

compare the off-time duration with a maximum off-time duration stored in the memory and a gap time; and determine that the hazardous condition is present when the processor determines that the off-time duration of the digital signal is less than or equal to the maximum off-time duration, and greater than or equal to the gap time.

10. The apparatus of claim 9, wherein the gap time is less than 10 percent of the minimum duration threshold.

11. A method performed by a hazard detector monitor for detecting when a hazardous condition is present inside a structure, comprising:

converting, by a transducer, a first pattern warning signal received from a first hazard detector and a second pattern warning signal received from a second hazard detector into a composite electronic signal;

converting, by an analog-to-digital converter, the composite electronic signal into a digital signal;

determining, by a processor, that the hazardous condition is present based on the digital signal; and transmitting, by the processor via a transmitter coupled to the processor, an alarm signal indicative of the hazardous condition to a receiver when the hazardous condition has been determined to be present.

12. The method of claim 11, wherein determining that the hazardous condition is present comprises:

determining, by the processor, an on-time duration of the digital signal as a time that the digital signal exceeded a first voltage threshold stored in the memory; and determining, by the processor, that the hazardous condition is present when the on-time duration is great than a minimum duration threshold stored in the memory, and less than a maximum duration threshold stored in the memory.

13. The method of claim 12, wherein the maximum duration threshold comprises a time that is twice the on-time of a temporal-3 signal, less a gap time.

14. The method of claim 13, wherein the gap time comprises a time period less than 10 percent of on on-time of the temporal-3 signal.

15. The method of claim 12, wherein the maximum duration threshold comprises a time that is twice the on-time of a temporal-4 signal, less a gap time.

16. The method of claim 15, wherein the gap time comprises a time period less than 10 percent of the on-time of the temporal-4 signal.

17. The method of claim 12, further comprising:

after determining the on-time of the digital signal, determining, by the processor, an off-time duration of the digital signal; and determining, by the processor, that the hazardous condition is present when the on-time duration of the digital signal is greater than the minimum duration threshold and less than the maximum duration threshold, and the off-time duration of the digital signal is less than or equal to a maximum off-time duration threshold stored in the memory.

18. The method of claim 17, wherein determining the off-time duration of the digital signal comprises:

determining, by the processor, an off-time duration that the digital signal remains below the first voltage threshold;

comparing, by the processor, the off-time duration with a maximum off-time duration stored in the memory; and determining, by the processor, that the hazardous condition is present when the processor determines that the off-time duration of the digital signal is less than or equal to the maximum off-time duration.

19. The method of claim 17, wherein determining the off-time duration of the digital signal comprises:

determining, by the processor an off-time duration that the digital signal remains below the first voltage threshold;

comparing, by the processor, the off-time duration with a maximum off-time duration stored in the memory and a gap time; and determining, by the processor, that the hazardous condition is present when the processor determines that the off-time duration of the digital signal is less than or equal to the maximum off-time duration, and greater than or equal to the gap time.

20. The method of claim 19, wherein the gap time is less than 10 percent of the minimum duration threshold.

* * * * *